US010512297B2

(12) United States Patent
Vamvas

(10) Patent No.: US 10,512,297 B2
(45) Date of Patent: Dec. 24, 2019

(54) ELECTRICAL POWER GENERATION FOOTWEAR

(71) Applicant: Vassilios Vamvas, Bedford, MA (US)

(72) Inventor: Vassilios Vamvas, Bedford, MA (US)

( * ) Notice: Subject to any disclaimer, the term of this patent is extended or adjusted under 35 U.S.C. 154(b) by 123 days.

(21) Appl. No.: 15/900,746

(22) Filed: Feb. 20, 2018

(65) Prior Publication Data

US 2019/0254380 A1 Aug. 22, 2019

(51) Int. Cl.
*A43B 3/00* (2006.01)
*A43B 7/04* (2006.01)
*A43B 13/20* (2006.01)

(52) U.S. Cl.
CPC ..... *A43B 3/0015* (2013.01); *A43B 7/04* (2013.01); *A43B 13/203* (2013.01)

(58) Field of Classification Search
CPC ..... A43B 3/0015; A43B 3/0005; A43B 7/04; A43B 7/02; A43B 13/203
See application file for complete search history.

(56) References Cited

U.S. PATENT DOCUMENTS 5,167,082 A * 12/1992 Chen ..... A43B 1/0036 219/211
5,918,381 A * 7/1999 Landry ..... A43B 1/0054 36/3 B
6,182,378 B1 * 2/2001 Sendaula ..... A43B 3/00 36/136
6,201,314 B1 * 3/2001 Landry ..... A43B 3/00 290/54
6,239,501 B1 * 5/2001 Komarechka ..... A43B 3/00 290/1 R
6,255,799 B1 * 7/2001 Le ..... A43B 3/00 219/211
6,281,594 B1 * 8/2001 Sarich ..... A43B 3/00 290/1 A
6,744,145 B2 * 6/2004 Chang ..... A43B 3/0005 219/211

(Continued)

FOREIGN PATENT DOCUMENTS

JP 2000236904 A * 9/2000
JP 2007330034 A * 12/2007

(Continued)

OTHER PUBLICATIONS

"A Generator for Your Shoes", Oct. 1, 2014; New Energy and Fuel (webpage); <https://newenergyandfuel.com/http:/newenergyandfuel/com/2014/10/01/a-generator-for-your-shoes/> (Year: 2014).*

(Continued)

*Primary Examiner* — John Villecco

(57) ABSTRACT

A pneumatic energy conversion mechanism for use with footwear generates electricity from foot-strikes. The mechanism comprises: at least one air-chamber with an outlet disposed to be compressed on foot strikes and decompressed when the foot is lifted; a micro-electrical generator supported within a support air tube pneumatically connected with the at least one air-chamber's outlet, at its one end, while having its other end open; at least one unidirectional axial-flow micro-turbine, such as the wells turbine, having all its blades exposed to the airflow, thus providing a powerful torque the same micro-electrical generator.

7 Claims, 5 Drawing Sheets

(56) References Cited

U.S. PATENT DOCUMENTS

| | | | | |
|---|---|---|---|---|
| 7,005,757 | B2 * | 2/2006 | Pandian | F03G 5/00 290/1 R |
| 7,327,046 | B2 * | 2/2008 | Biamonte | A43B 3/00 290/1 A |
| 7,426,793 | B2 * | 9/2008 | Crary | A43B 7/081 36/114 |
| 7,956,476 | B2 * | 6/2011 | Yang | A43B 3/00 290/1 R |
| 8,907,505 | B2 * | 12/2014 | Fortier | A43B 3/0015 290/1 R |
| 9,303,628 | B2 * | 4/2016 | Fortier | A43B 3/0015 |
| 9,359,992 | B2 * | 6/2016 | Ignatchenko | F03B 17/005 |
| 10,280,902 | B2 * | 5/2019 | Ignatchenko | F03B 17/005 |
| 2006/0021261 | A1 * | 2/2006 | Face | A43B 3/00 36/132 |
| 2013/0020986 | A1 * | 1/2013 | Linzon | A43B 3/0015 320/107 |
| 2013/0033042 | A1 * | 2/2013 | Fortier | A43B 3/0015 290/54 |
| 2014/0250875 | A1 * | 9/2014 | Ignatchenko | F03B 17/005 60/325 |
| 2015/0076832 | A1 * | 3/2015 | Fortier | A43B 3/0015 290/1 R |
| 2015/0320137 | A1 * | 11/2015 | Fortin | A43B 13/203 60/327 |
| 2016/0273522 | A1 * | 9/2016 | Ignatchenko | F03B 17/005 |
| 2016/0344309 | A1 * | 11/2016 | Otagiri | H02N 2/18 |
| 2016/0351774 | A1 * | 12/2016 | Schneider | H01L 35/30 |
| 2018/0206586 | A1 * | 7/2018 | Akay | A43B 3/0015 |
| 2019/0053572 | A1 * | 2/2019 | Patton | A43B 13/206 |

FOREIGN PATENT DOCUMENTS

| | | | | |
|---|---|---|---|---|
| JP | 2008141934 | A * | 6/2008 | |
| JP | 2008208767 | A * | 9/2008 | |
| KR | 20040040596 | A * | 5/2004 | |
| KR | 20110047324 | A * | 5/2011 | |
| WO | WO-2014058352 | A2 * | 4/2014 | H02K 7/1853 |

OTHER PUBLICATIONS

Fu et al.; "Energy Harvesting from Human Motion Using Footstep-Induced Airflow"; 2015; Journal of Physics: Conference Series; 660 012060; pp. 1-5 (Year: 2015).*

Frontoni et al.; "Energy Harvesting for Smart Shoes: A Real Life Application"; Aug. 2013; Proceedings of the ASME 2013 International Design Engineering Technical Conferences & Computers and Information in Engineering Conference IDETC/CIE 2013; pp. 1-6 (Year: 2013).*

Lavars, Nick; "Kinetic energy-harvesting shoes a step towards charging mobile devices on the go"; Feb. 12, 2016; New Atlas (webpage) <https://newatlas.com/energy-harvesting-shoes/41796/> (Year: 2016).*

* cited by examiner

ELECTRICAL POWER GENERATION FOOTWEAR

CROSS-REFERENCE TO RELATED APPLICATIONS

This application claims the benefit of U.S. provisional patent application Ser. No. 62/460,831 submitted by the same inventor and incorporated herein by reference in its entirety.

BACKGROUND

The following is a tabulation of some prior art that presently appears relevant:

| U.S. Patents | | | |
|---|---|---|---|
| Pat. No. | Kind Code | Issue Date | Patentee |
| 7,956,476 | B2 | 2011 Jun. 7 | Yang |
| 7,426,793 | B2 | 2008 Sep. 23 | Crary |
| 7,327,046 | B2 | 2008 Feb. 5 | Biamonte |
| 7,005,757 | B2 | 2006 Feb. 28 | Pandian |
| 6,744,145 | B2 | 2004 Jun. 1 | Chang |
| 6,281,594 | B1 | 2001 Aug. 28 | Sarich |
| 6,255,799 | B1 | 2001 Jul. 3 | Le et al. |
| 5,167,082 | | 1992 Dec. 1 | Chen |

| U.S. Patent applications | | | |
|---|---|---|---|
| Pat. No. | Kind Code | Issue Date | Applicant |
| 20160351774 | A1 | 2016 Dec. 1 | Schneider et al. |
| 20060021261 | A1 | 2006 Feb. 2 | Face |

| WO Patent applications | | | |
|---|---|---|---|
| Patent Number | Kind Code | Issue Date | Applicant |
| EP2941971 | A1 | 2015 Nov. 11 | Fortin et al. |

FIELD OF USE

The present invention relates to energy harvesting from bodily motion and more specifically to pneumatic excitation of turbines embedded in footwear.

DESCRIPTION OF THE PRIOR ART

Renewable electrical power generation from bodily motion is described in prior art. US patent application Ser. No. 20160351774 relates to an energy harvesting device adapted for use by an athlete to collect thermal energy through a phase change material, which subsequently is converted to electricity. A large spectrum of mobile applications can benefit by such a production of electricity spanning from foot warmers and mobile medical devices to mobile phones, Global Positioning Systems, entertainment electronics and Internet of Things applications, such as internet connected goggles displaying information.

Foot compression on footwear has been extensively described in prior art, especially using piezoelectricity and mechanical gear trains. U.S. patent application with Ser. No. 20060021261 describes an article of footwear which includes a piezoelectric actuator to generate electricity. Shenk and Paradiso have extensively studied piezoelectric actuators in footwear, as described in publication: N. Shenck, J. Paradiso, "Energy Scavenging with Shoe-Mounted Piezoelectrics", in IEEE Micro, Vol. 21, Issue 3, May/June 2001, pp. 30-42. U.S. Pat. No. 8,841,822, submitted by the same inventor and incorporated herein by reference, describes a piezoelectric generator, which can be used embedded in footwear to generate electricity.

U.S. Pat. No. 6,255,799 describes a means for generating energy, while walking or running, for storage in a rechargeable battery. This means comprises a built in the shoe generator, which utilizes a circular gear assembly to rotate a generator. The same patent describes a second embodiment, which uses fluid reservoirs embedded in the shoes. Pressure changes, resulting from normal walking or running, move the fluid through a closed hydraulic circuit including a narrow channel connecting two reservoirs, thus generating power by rotating a turbine, unidirectionally.

U.S. Pat. No. 7,956,476 describes a system for harvesting energy from footwear movement, which involves compression and decompression of chambers situated in the footwear, such as a back chamber in the heel area and a front chamber in the toe area of the footwear. The chambers are filled with gas, which moves in and out upon compression and decompression of the chambers. The chambers may have elastomer walls which facilitate compressibility and decompressibility of the chambers. The system utilizes a closed pneumatic rectification circuit which directs the gas, through a nozzle, to a micro-turbine generator unit, to rotate the generator unidirectionally. The turbine used is of the radial-flow kind, where the turbine's shaft is placed perpendicular to the direction of the gas stream. For a given airflow, radial-flow turbines require more axial space, particularly for multiple radial-flow turbine configurations. This is because the gas-stream is applied only to a subset of the turbine blades, whereas the axial flow turbines have all their blades absorbing kinetic energy from the working fluid at the same time. More axial space occupying applications are not as suitable in footwear applications, where available space is limited.

Fu et al. publication: H. Fu, K. Cao, R. Xu, M. Bhouri, R. Martinez-Botas, S. G. Kim, E. Yeatman, "Footstep Energy Harvesting Using Strike-Induced Airflow for Human Activity Sensing," in *Wearable and Implantable Body Sensor Networks*, IEEE Xplore, 2016, describes and analyzes the efficiency of an air-bladder turbine energy harvester, embedded in shoes, to convert the footstep strikes into electrical energy. When a foot-strike compresses the air-bladder, an airflow is created. The airflow enters an air-pathway, which includes a radial-flow air-turbine, and then exits the pathway from an open end which follows. When the foot is lifted the air-bladder decompresses, which creates an air-flow in the opposite direction. The radial-flow turbine mechanism, as shown in the paper occupies considerable axial space. The research paper concludes that, although the miniature radial-flow turbine was optimized using Computational Fluid Dynamics, still the efficiency of the system was low and not all the airflow power potential was captured. An obvious method to capture the "leaking" airflow would have been to add more radial-flow turbine stages on the airflow pathway. However, this would have occupied even more axial space which would make the mechanism more bulky for use with footwear. Also more stages would require either additional gearing parts and/or generators which may further increase the mechanism's geometric size and cost. Therefore it is clear that there is a need for a more efficient mechanism.

SUMMARY

The present invention discloses a pneumatic energy converting mechanism for use with footwear in order to generate electricity from foot-strikes, when the footwear user walks, runs, jumps or, in general exerts pressure with bodily motion on footwear.

The mechanism is embedded in the footwear and comprises at least one air-chamber which has an air-outlet and is disposed to be compressed on foot strike and decompressed when the foot is lifted. The air-chamber(s) can be placed under the foot parts, which exert pressure on the footwear, such as the heel, the ball of the foot, the toes, etc. The mechanism also includes a micro-electrical rotational generator supported within a support air tube which, is pneumatically connected with the air-chamber's outlet with its one end, while having its other end open, so that when the air-chamber is compressed, air flows from the chamber through the support tube and escapes out from the support tube's open end, and when the air-chamber decompresses, air is drawn in from the support tube's open end and flows through the generator area back to the air-chamber.

The micro-electrical generator's shaft coincides with the support tube's longitudinal axis of symmetry, which is the tube's central axis. Attached on this shaft is at least one unidirectional axial-flow turbine. The axial flow turbine blades cut the airflow flowing through the support tube. All blades of each axial-flow turbine are exposed to the airflow absorbing kinetic energy from the air-flow, at the same time, thus efficiently exerting torque rotation to the shaft, while occupying less axial space than if a radial-flow turbine was used. Additional axial flow turbines are added on the same shaft, if airflow "leakage" exists, thus providing with a more cost effective and efficient solution, than utilizing radial-flow turbines with additional generators and/or gearing parts.

The at least one axial-flow turbine, included in the mechanism, is also a unidirectional turbine. That is, independently from the direction of the oscillating airflow (created by the air-chamber compression and decompression), the at least one axial-flow turbine rotates in the same direction. The at least one axial-flow turbine can be of the Wells turbine kind, which possesses the unidirectional property when exposed to an axially oscillating working fluid, and it is well known in the art. Of course, if more than one axial-flow unidirectional turbines are used, these are installed in the same way to provide rotation in the same direction. More than one unidirectional axial-flow turbines can be used in both sides of the generator shaft, provided that the shaft is extended from both sides of the generator.

It is, therefore, an object of the present invention to utilize more than one axial flow micro-turbines and produce rotational torque applied to the same micro-generator, avoiding airflow "leakage". Applying additional torque to the same micro-generator, results in the capability of handling larger electrical load and producing more electrical power.

It is also an object of the present invention to capture the available airflow power with all micro-turbine blades and NOT only with a small subset of them, as opposed to the radial turbines. This results in less axial space occupation within the footwear.

Yet, it is an object of the present invention to further maximize the benefit of the oscillating airflow, when more than one air-chambers are used. If two or more air-chambers are disposed for a foot-strike from different parts of the foot, such as the heel, the ball of foot or the toes, their compressions and decompressions during walking, jumping etc. are not synchronized and therefore occasionally, airflows created from the compression and decompression of different chambers, at the same time, may travel concurrently in two opposite directions through the same pathway, thus having air particles colliding to each other and therefore partially cancelling the desirable airflow's kinetic energy potential. So, it is an object of the present invention to maximize the benefit of the oscillating airflow energy potential by making the airflow pathways of two or more chambers, independent, that is not interfering with each other, yet having the these independent airflows acting on the same turbines and generator, thus providing a more efficient electrical power generation.

LIST OF FIGURES

DETAILED DESCRIPTION

The present disclosure describes a pneumatic electricity generation mechanism embedded in footwear. The mechanism includes at least one air-chamber with an outlet, which is placed so that it is compressed by the foot, while walking running, jumping and in general when the foot applies pressure, such as the pressure exerted on the footwear by the heel or the ball of the foot. When the air chamber is compressed, an airflow exits the air chamber through its outlet. When the foot is lifted the air-chamber decompresses. When the air chamber decompresses an air flow enters the air chamber through the outlet, at the opposite direction from the airflow created during the air-chamber compression. The air-chamber can be made by an elastomeric material such as the one used for air-bulbs in sphygmomanometers, so that after compression and during decompression the air-chamber returns to the form it had before compression. To return to the uncompressed form, the air-chamber may further contain decompression means, such as a sponge or flexible foam material or flexible polyurethane foam, which can be compressed on compression and expand back into its initial shape after compression, pushing the internal air chamber walls to return to the uncompressed form; or springs, placed inside the air chamber, which can be compressed and expand back to their initial uncompressed length or state, during decompression, thus pushing the air-chamber's walls, internally, back to the uncompressed form.

Figure 1:
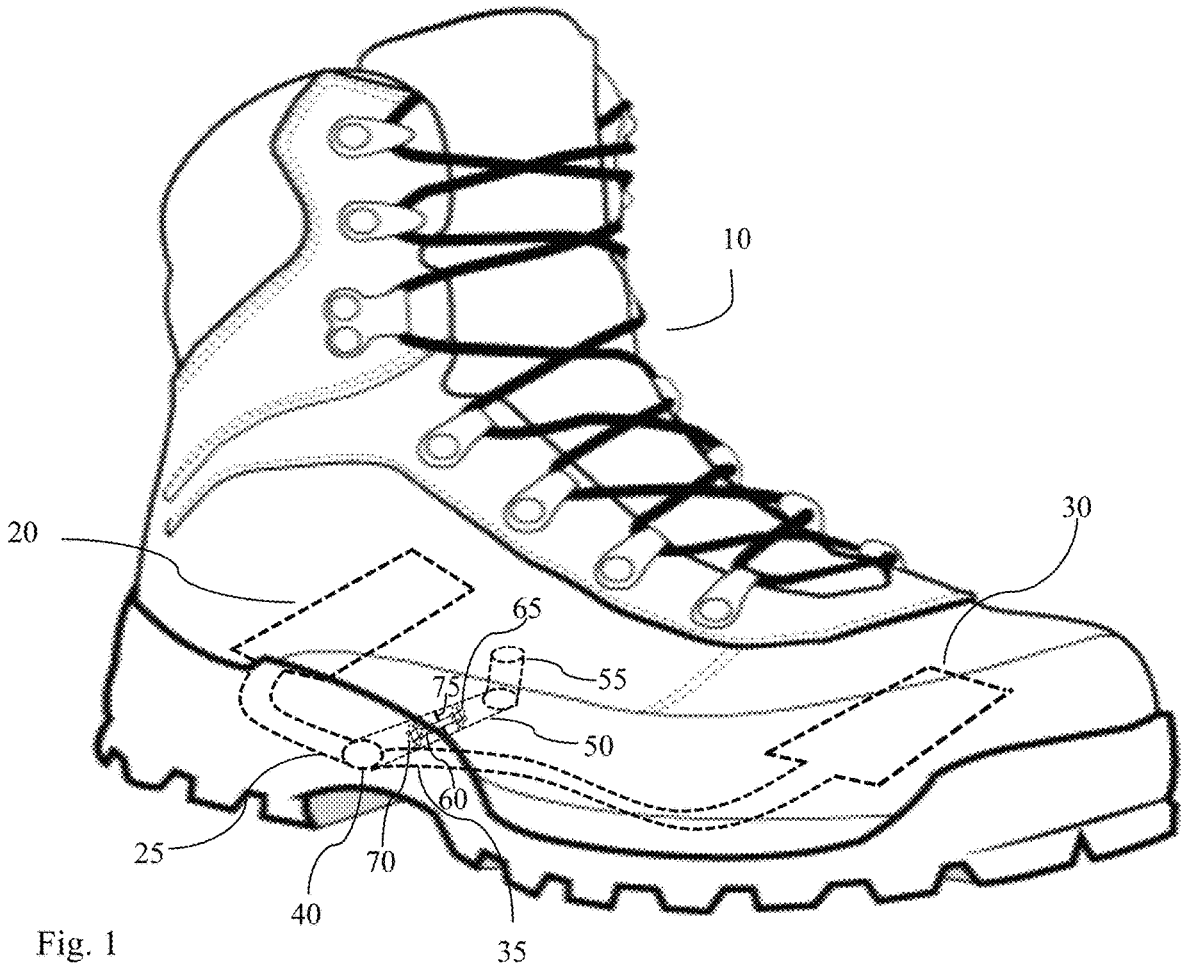
FIG. 1 shows a perspective view of footwear with the electricity generation mechanism.
Figure 3:
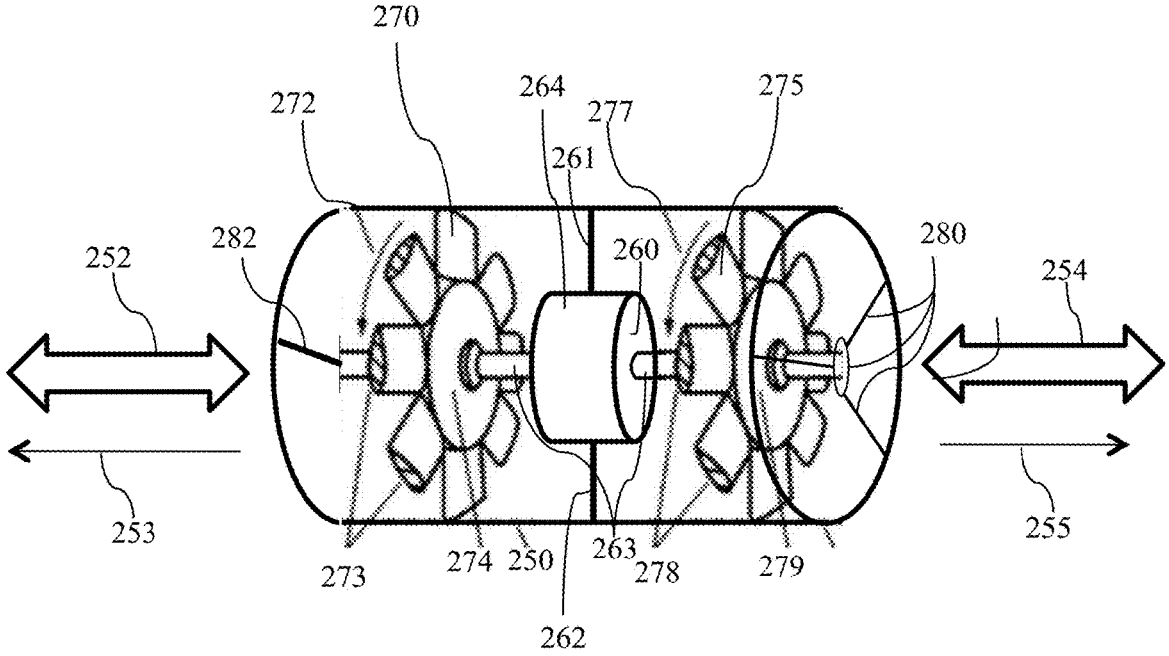
FIG. 3 shows a part of the support tube including two axial-flow unidirectional turbines (Wells) rotationally attached on a micro-electrical generator.

FIG. 1 shows a preferred embodiment utilizing two air-chambers, 20 and 30, placed in footwear 10 to be compressed by the heel and the ball of the foot respectively. FIG. 1 also shows air outlets 25 and 35, pneumatically connected to a Y-joint pipe 40, pneumatically connecting outlets 25 and 35 to the one end of support tube 50. Support tube 50 houses the electricity generation mechanism. The airflows created from the compression of chambers 20 and 30 are forced to pass through support tube 50, which has and exit through its open end extension 55. These air flows activate the rotation of axial flow micro-turbines 60 and 65, which are contained for rotation within the support 50, as follows: micro rotational generator 60 is placed inside the support tube and is fixed in position by at least one support, fixed on the tube wall, such as support 75. Support 75 supports the generator 60 so that the generator's shaft coincides with the longitudinal axis of symmetry of the support tube 50. FIG. 3 shows in more detail the micro rotational generator, the generator's rotor shaft, the generator's support bars, which keep it fixed in the center of the support tube and the axial flow unidirectional micro-turbines attached on the generator's rotor shaft.

FIG. 1 shows axial flow micro-turbines 65 and 70 attached for rotation on generator 60. Axial-flow turbines are turbines in which the flow of the working fluid is parallel to the turbine shaft, as opposed to radial turbines where the fluid runs around a shaft, as in a watermill. All the blades of an axial flow turbine are exposed to the working fluid, whereas only a subset of the total number of blades of a radial flow turbine is exposed to the working fluid. The axial-flow turbines occupy less axial space than the radial flow ones, which is very critical for the efficiency of a footwear electricity generating mechanism, as discussed above.

Axial-flow micro-turbines 65 and 70 are additionally of the unidirectional kind, that is, they rotate always in the same direction independently from the direction of the working fluid that crosses and sets in rotation the turbine blades. Axial-fowl turbines are the Wells turbines, which are well known in the art. Micro-turbines 65 and 70 are placed within the support tube 50 to rotate freely without touching the support tube wall. The micro-turbines are attached on the generator's rotor shaft, as shown in more detail in FIG. 3. FIG. 1 further shows support tube 50 which leads to an open ended pipe extension 55. When the air-chambers are compressed, air flows into the support tube 50 with a direction towards the open end 55, while they rotate micro-turbines 70 and 65, which in turn rotate the generator's rotor producing electricity. When the foot is lifted, the air-chambers decompress inhaling air from open end 55 thus creating an airflow, which has the opposite direction from the airflow created by the compression of the air chambers. As micro-turbines are unidirectional, they keep rotating in the same direction as the direction they had during compression.

The preferred embodiment shown in FIG. 1 utilizes two unidirectional micro-turbines. Other preferred embodiments utilize more than two micro-turbines, or only one, depending on the available airflow. All micro-turbines act upon only one generator. This provides with increased torque to the rotor shaft, producing more power. The electricity generated by the micro-generator is provided through cables to an electrical load, such as a battery recharger, mobile phones, RF radios, GPS systems, electronic medical and entertainment devices, electrical resistor foot warmers, light bulbs/LEDs etc. (not shown).

Figure 2:
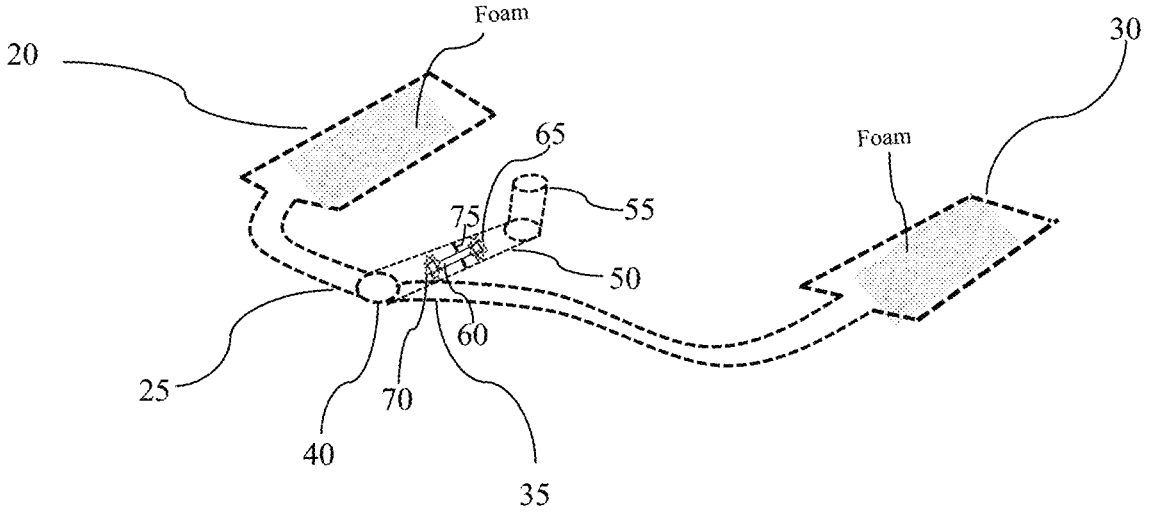
FIG. 2 shows only the electricity generation mechanism embedded in the footwear of FIG. 1.

FIG. 2, for more clarity, shows the footwear generation mechanism of FIG. 1 without the footwear. FIG. 3 shows support tube, 250, which houses and supports the electricity generation mechanism, in a preferred embodiment that utilizes two Wells turbines. Micro-generator 260 is securely fixed on support tube 250 with supports 261 and 262. These are fixed on the support tube's wall and the generator's stator wall 264. Axial micro-turbines 270 and 275 are securely attached for rotation on the micro-generator's shaft 263, which in this embodiment extends from both sides. Axial micro-turbines 270 and 275 are attached on shaft 263 with hubs 274 and 279, respectively. Blades or air-foils, such as 273 and 278 are fixed on hubs 274 and 279 respectively. Arrows 252 and 254 show the directions of the oscillating airflow produced by the compression and decompression of the air-chambers. Micro-turbines 270 and 275 are unidirectional Wells turbines. They can freely rotate unidirectionally, inside support tube 250, always in the same direction indicated by arrows 272 and 277. This is succeeded because the micro-turbines 270 and 275 are Wells turbines, which have symmetrical air-foils, such as the air-foils 273 and 278. Other preferred embodiments have more than two micro-turbines. Generator shaft 263 may further be supported for rotation with a bearing support, such as bearing supports 280 and 282, which are fixed in position connected to the support tube 250.

Figure 4:
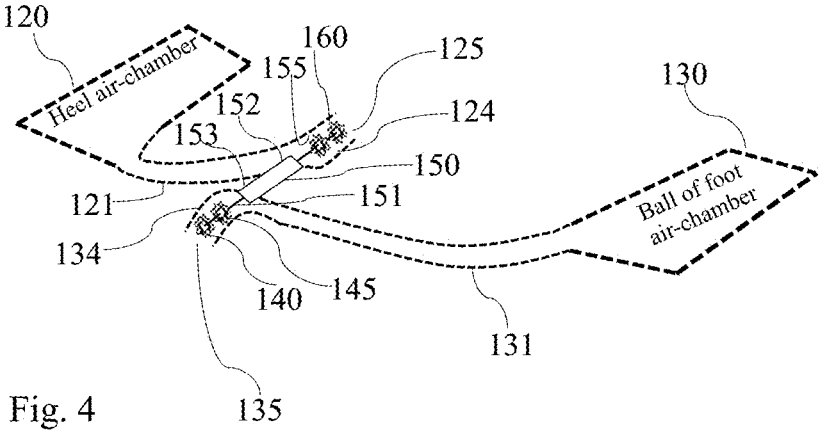
FIG. 4 shows the footwear embedded electricity generation mechanism with independent airflow pathways.

The preferred embodiment of FIG. 4 utilizes two air-chambers with independent air-pathway outlets in order to allow for airflows which do not meet, but act on the same generator. The preferred embodiment shown in FIG. 4, which purposely omitted showing the footwear for more clarity of the mechanism, utilizes four micro-turbines, two for each air path way outlet. Another preferred embodiment utilizes one micro-turbine per air path way outlet. FIG. 4 further shows within the air-pathway, the micro-turbines attached in each side of the generator. The micro-generator stator wall ends are fixed on the air-pathway walls. This preferred embodiment avoids having airflows flowing in opposite directions, at the same time, and having their air particles colliding within the same air-pathway. This further optimizes the power capture of the airflows, as discussed in the Summary section above. Still, this preferred embodiment utilizes only one generator.

FIG. 4 shows, heel area air-chamber 120 and ball of foot area air-chamber 130 having air pathway outlets 121 (the heel air flow) and 131 (the ball-of-foot air-flow) with outlet open ends 125 (heel open end) and 135 (ball-of-foot), respectively. Respectively also they have air-chamber outlet tube support parts 124 (the heel part) and 134 (the ball-of-foot part), each housing a set of two unidirectional axial turbines attached on the generator rotor shaft extension. Also, each outlet tube support part supports, fixed in position, the generator stator wall end 153 and stator wall end 152, of generator 150, respectively. Micro-turbines 155, 160 and 140, 145, are unidirectional turbines, and can be of the Wells turbine kind. These turbines are attached for rotation on the micro-generator shaft 151, which extends from both sides of the micro-generator 150. The longitudinal axes of outlet tube support parts 124 (heel part) and 134 (ball-of-foot part) are aligned in a straight line and are also aligned with micro-generator 150 stator's longitudinal axis and shaft. When heel air-chamber 120 generates a heel air flow with a one direction and at the same time ball of foot air-chamber 130 produces a ball of foot airflow at the opposite direction, these airflows never meet, since their corresponding air-pathways are independent from each other. Therefore, unidirectional turbine pairs 155, 160 and 140, 145, which always rotate in the same direction, receive unobstructed full power potential of each airflow, which leads to a more powerful rotational torque applied to the same shaft of the same micro-generator 150, thus further increasing the system's efficiency.

Figure 5:
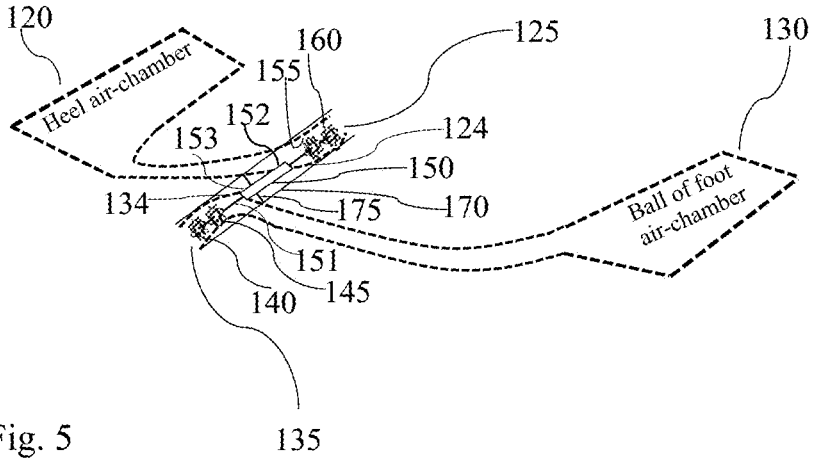
FIG. 5 shows the embedded electricity generation of mechanism of FIG. 4 reinforced with a support jacket tube which further secures axial alignment of the electricity generation parts.

FIG. 5 shows the same mechanism of FIG. 4 with the addition of a jacket support tube 170. The preferred embodiment of FIG. 5 utilizes jacket support tube 170 to further secure the alignment of the longitudinal axes of outlet tube support parts 124 and 134 along with the micro-generator shaft's 151. At least one support bar 175 supports micro-turbine 150 on the jacket support tube 170 to further stabilize the micro-turbine 150 in position. Jacket support tube 170 further secures the operation of the electricity generation mechanism in the mobile footwear environment, thus lowering maintenance needs and increasing the system's life cycle, which decrease the overall total ownership cost.

The invention claimed is:

1. A pneumatic energy converter mechanism for footwear comprising:

at least one compressible and decompressible air-chamber an outlet; said air-chamber secured within the footwear, producing an airflow with a one direction on a said air-chamber's compression and with an opposite to said one direction on a said air-chamber's decompression;

a micro-electrical rotational generator supported within a support air tube having a first end and an open second end;

a means for pneumatically connecting said at least one air-chamber's outlet with said support air tube's first end;

at least one unidirectional axial-flow micro-turbine attached for rotation on said micro-electrical rotational generator, within said support air tube; said at least one unidirectional axial-flow micro-turbine having a set of blades all being exposed at the same time to said air-flow, whereby said at least one unidirectional axial-flow micro-turbine always rotates unidirectionally when exposed to said airflow with said one direction and said opposite to said one direction and captures said air-flow with said set of blades all being exposed at the same time to said airflow, generating a powerful torque for said micro-electrical rotational generator.

2. The pneumatic energy converter mechanism of claim 1 wherein:

said at least one unidirectional axial-flow micro-turbine is a unidirectional Wells turbine.

3. The pneumatic energy converter mechanism of claim 1 wherein:

said at least one compressible and decompressible air-chamber with is two compressible and decompressible air-chambers secured in said footwear under the heel and the ball of the foot respectively.

4. The pneumatic energy converter mechanism of claim 1 further including:

a flexible foam material contained within said at least one compressible and decompressible air-chamber.

5. A pneumatic energy converter mechanism for footwear comprising:

a heel compressible and decompressible air-chamber with a heel outlet tube having a heel open end, secured within the footwear within the heel portion of the footwear, producing a heel airflow with a heel one direction on a heel compression of said heel air-chamber and a heel opposite to said heel one direction on a heel decompression of said heel air-chamber;

a ball-of-foot compressible and decompressible air-chamber with a ball-of-foot outlet tube having a ball-of-foot open end, secured within the footwear within the ball portion of the footwear, producing a ball-of-foot airflow with a ball-of-foot one direction on a ball-of-foot compression of said ball-of-foot air-chamber and a ball-of-foot opposite to said ball-of-foot one direction on a ball-of-foot decompression of said ball-of-foot air-chamber;

at least one heel unidirectional axial-flow micro-turbine being housed within a heel part of said heel outlet tube with a heel part longitudinal axis of symmetry, to axially receive said heel airflow;

at least one ball-of-foot unidirectional axial-flow micro-turbine being housed within a ball-of-foot part of said ball-of-foot outlet tube with a ball-of-foot part longitudinal axis of symmetry, to axially receive said ball-of-foot airflow; said heel part longitudinal axis of symmetry coincides with said ball-of-foot part longitudinal axis of symmetry;

a micro-rotational generator with a micro-rotational generator shaft coinciding with said heel and ball-of-foot part longitudinal axes, and being extended within said heel part of said heel outlet tube and said ball-of-foot part of said ball-of-foot outlet tube, and having attached said at least one heel and ball-of-foot axial-flow micro-turbines, wherein said micro-rotational generator is securely supported on said heel part of said heel outlet tube and said ball-of-foot part of said ball-of-foot outlet tube, whereby said heel and ball-of-foot airflows do not interfere with each other, while powering said micro-rotational generator.

6. The pneumatic energy converter mechanism of claim 5 further including:

a jacket support tube for securely aligning said micro-rotational generator shaft with said heel part and ball-of-foot part longitudinal axes of symmetry.

7. The pneumatic energy converter mechanism of claim 5 wherein:

said at least one heel and ball-of-foot axial flow micro-turbines are unidirectional Wells turbines.

* * * * *